US011331527B2

(12) United States Patent
Hakala et al.

(10) Patent No.: US 11,331,527 B2
(45) Date of Patent: May 17, 2022

(54) METHOD OF DESTRUCTING TOXIC CHEMICALS

(71) Applicant: Helsingin yliopisto, Helsingin Yliopisto (FI)

(72) Inventors: Ullastiina Hakala, Helsinki (FI); Risto Hakala, Helsinki (FI)

(73) Assignee: Helsingin Yliopisto, Helsinki (FI)

( * ) Notice: Subject to any disclaimer, the term of this patent is extended or adjusted under 35 U.S.C. 154(b) by 845 days.

(21) Appl. No.: 15/775,403

(22) PCT Filed: Nov. 12, 2015

(86) PCT No.: PCT/FI2015/050790
§ 371 (c)(1),
(2) Date: May 11, 2018

(87) PCT Pub. No.: WO2017/081358
PCT Pub. Date: May 18, 2017

(65) Prior Publication Data

US 2018/0345062 A1 Dec. 6, 2018

(51) Int. Cl.

| | |
|---|---|
| ***A62D 3/34*** | (2007.01) |
| ***A62D 3/32*** | (2007.01) |
| ***A62D 3/35*** | (2007.01) |
| ***A62D 3/38*** | (2007.01) |
| *A62D 101/02* | (2007.01) |
| *A62D 101/04* | (2007.01) |

(52) U.S. Cl.
CPC ..... *A62D 3/32* (2013.01); *A62D 3/35* (2013.01); *A62D 3/38* (2013.01); *A62D 2101/02* (2013.01); *A62D 2101/04* (2013.01); *A62D 2203/04* (2013.01)

(58) Field of Classification Search
CPC ... A62D 3/32; A62D 3/35; A62D 3/38; A62D 2101/02; A62D 2101/04
USPC ..... 588/314
See application file for complete search history.

(56) References Cited

U.S. PATENT DOCUMENTS

| | | | |
|---|---|---|---|
| 5,100,477 | A | 3/1992 | Chromecek et al. |
| 5,859,064 | A | 1/1999 | Cronce |
| 7,276,468 | B1 | 10/2007 | Tucker |
| 2009/0012345 | A1 | 1/2009 | Al Nashef et al. |
| 2009/0012346 | A1 | 1/2009 | Al Nashef et al. |
| 2009/0216060 | A1 | 8/2009 | Monzyk et al. |
| 2010/0119412 | A1 | 5/2010 | Conrad |
| 2012/0149963 | A1 | 6/2012 | Al Nashef et al. |

FOREIGN PATENT DOCUMENTS

| | | | |
|---|---|---|---|
| EP | 0607420 | B1 | 11/2009 |
| WO | WO0226701 | A2 | 4/2002 |
| WO | WO2005103700 | A1 | 11/2005 |

OTHER PUBLICATIONS

Dai et al: Natural deep eutectic solvents as new potential media for green technology. Analytica Chimica Acta, Elsevier, 2013, pp. 61-68.

*Primary Examiner* — Edward M Johnson
(74) *Attorney, Agent, or Firm* — Laine IP Oy

(57) ABSTRACT

There are disclosed processes for destructing a toxic chemical including the steps of mixing the toxic chemical with a liquid phase formed by an aqueous mixture of water and an ionic liquid or molten salt which is miscible with water, the ionic liquid or molten salt comprising a tertiary amine group or quaternary ammonium group; and contacting the toxic chemical in the liquid phase with the ionic liquid or molten salt so as to decompose the toxic chemical.

29 Claims, 6 Drawing Sheets

METHOD OF DESTRUCTING TOXIC CHEMICALS

FIELD OF INVENTION

The present invention relates to destruction of toxic chemicals. In particular the invention concerns a method and a composition of destructing toxic chemicals, such as chemical warfare agents. The invention also concerns novel uses of the compositions.

BACKGROUND

Chemical warfare agents (CWAs) are toxic chemicals which are capable of being used to kill, injure or incapacitate an opponent in warfare and related military actions. Common CWAs are nerve agents (tabun, sarin, soman and VX), blister agents (mustard gas, nitrogen mustard) and arsenical vesicants (lewisites), including diphenylcyanoarsine, diphenylaminechlorarsine and diphenylchlorarsine.

CWAs were used by both sides during the First World War and resulted in more than 100,000 deaths. After the First World War, chemical weapons have still reportedly caused more than one million casualties globally.

As a result of public outrage, the Geneva Protocol which prohibited the use of chemical weapons in warfare, was signed in 1925. The protocol did not prohibit the development, production or stockpiling of chemical weapons, which is reflected by the fact that by the 1970s and 80s, an estimated 25 States were developing chemical weapons capabilities. A convention (abbreviated CWC) on the Prohibition of the Development, Production, Stockpiling and Use of Chemical Weapons and on Their Destruction was adopted by the Conference on Disarmament in Geneva on 3 Sep. 1992. The CWC allows for the stringent verification of compliance by State Parties.

Even after the second Geneva Convention, chemical warfare agents have been used in conflicts and by terrorist groups.

In view of the stockpiling and still continuing use of CWAs there is a need for proper means of environmentally safe destruction of CWAs and other toxic compounds as well as for decontaminating objects and surfaces contaminated with such substances.

In addition to CWAs there are a number of toxic chemicals which may need to be safely destructed and removed from surfaces by decontamination. Examples include organic and inorganic pesticides, insecticides and herbicides, and residues thereof, as well as other organic and inorganic agents, such as phosgene, diphosgene, chlorine, hydrogen cyonide, cyanogen chloride and arsine.

Decontamination of toxic compounds can be carried out by physical decontamination, such as rubbing or scrubbing, flushing, rinsing, by applying pressure, heat or radiation. Further, biological decontamination, can be performed by enzymes or synthetic bacteria. Finally, chemical decontamination is carried out with chemicals and compositions which are capable of achieving chemical reactions (such as hydrolysis, oxidation) which lead to the destruction of CWAs.

Chemical decontamination solutions are usually based on acidic or basic liquids, in particular aqueous solutions, optionally in combination with absorbent materials, such as macroporous cross-linked copolymer powders (cf. for example U.S. Pat. No. 5,100,477). There is a plethora of options, including sodium dichloroisocyanurate, sodium or calcium hypochlorite, hydrogen peroxides, amino compounds, phosphates, borates, carbonates optionally in combination with complexes, stabilizers and silicates.

US Patent Application Publication No. 20100119412 discloses a system for decontaminating or disinfecting chemical and biological toxicants comprising a binary base mix including a water-soluble organic amphipathic solvent, a reactive oxygen species (ROS), and water; and an activator that provides a buffering system to establish and maintain a pH of between about 8.0 to about 8.5. The base mix and the activator are mixed to form a single-phase aqueous decontamination solution, and that solution produces and maintains a sufficient amount of singlet oxygen molecules and/or percarboxylate anions to decontaminate a threat load of toxicant.

Both physical and biological methods are hampered by uncertainty of completeness of the CWA destruction. While present-day chemical methods provide for sufficient destruction of CWAs, the active components of chemical compositions can be harmful or even toxic in themselves as are the decomposition products. When selecting a decomposition method for use on a large scale, it is particularly important to consider the decomposition products. In order for the decomposition to be successful, all or substantially all the compounds formed during large-scale decomposition need to be identified and their biological properties need to be assessed. Important features are the structure of the compounds, the $LD_{50}$ values thereof and the physico-chemical properties.

To illustrate the above, it can be mentioned that when the nerve gas VX is decomposed by hydrolyzation, the compound formed, EA2192, is almost as toxic ($LD_{50}$ approx. 0.63 mg/kg), as the nerve gas itself (VX: $LD_{50}$ approx. 0.1 mg/kg). Similarly, when mustard gas ($LD_{50}$ approx. 17 mg/kg) is treated in alkaline decomposition solutions by causing an elimination reaction, the main reaction product is divinyl sulphide ($LD_{50}$ approx. 170 mg/kg), which is merely one decade of magnitude less toxic than mustard gas itself. The most desirable decomposition product of mustard gas would be thiodiglycol ($LD_{50}$ 6610 mg/kg) formed by hydrolytic reactions.

SUMMARY OF INVENTION

It is an aim of the present invention to provide an environmentally friendly decontamination method for chemical warfare agents (CWAs).

It is another aim of the present invention to provide a composition comprising a dry blend of chemical components suitable for used in methods of destruction and decontamination of toxic compounds.

It is a third aim of the present invention to provide an aqueous composition suitable for use in methods of destruction and decontamination of toxic compounds.

It is a fourth aim of the present invention to provide for uses of the compositions.

The present invention is based on the concept of using ionic liquids or molten salts for destructing toxic chemicals in aqueous liquids.

In the method,

- a toxic chemical is mixed with a liquid phase formed by an aqueous mixture of water and an ionic liquid or molten salt which is miscible with water, the ionic liquid or molten salt comprising a tertiary amine group or quaternary ammonium group; and
- the toxic chemical is contacted in the liquid phase with the ionic liquid or molten salt so as to decompose said toxic chemical.

Considerable advantages are obtained with the invention. Thus, efficient decontamination of contaminated surfaces and destructing or decomposition of toxic substances are achieved by using environmentally friendly solvents and reactants which are non-toxic and which yield reaction products which are substantially non-harmful or even non-toxic.

Today, chemical and biological warfare agents are destroyed using different destructing compositions, typically a specific composition has been developed for each agent. Successful decomposition requires proper identification of the CWA which often is difficult in field conditions. By contrast the present compositions can be used for various CWAs but also for biological warfare agents.

The present decontamination method is based on the use of nontoxic or essentially harmless starting materials and reaction products. No waste is generated and the degradation products are safe. The method is usable both in cold and warm conditions, as well at the sub-zero conditions in polar regions as in the hot conditions in deserts, semideserts and tropical regions. The compositions are stable over a broad temperature range. Similarly, the composition can be used with present application methods.

The components used in the decontamination or decomposition compositions have good surface properties such that sufficient duration of action is achieved. Compared with conventional decomposition solutions, the concentration of oxidative agents can be kept much smaller. Corrosion of treated surface can be avoided due to suitable pH of the aqueous compositions.

The components are inexpensive and the present compositions are readily produced even on an industrial scale. The compositions are easy and safe to store and transport.

DESCRIPTION OF EMBODIMENTS

Figure 1:
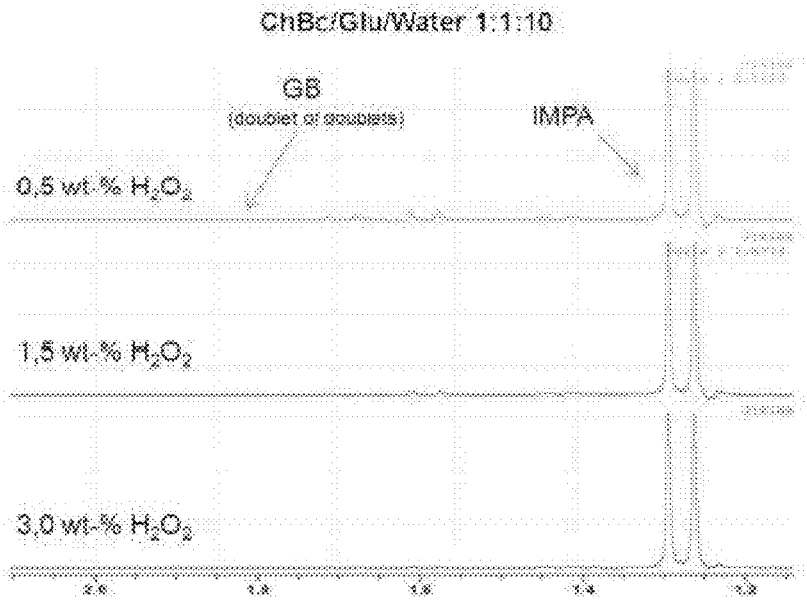
FIG. 1 shows a 1D $^{1}H$-$^{31}P$ HSQC spectrum after 1 hour decontamination of sarin using the present compositions at three different concentrations of hydrogen peroxide and BD60 (choline bicarbonate-glucose-$H_2O$ 1:1:10)

In the present context, the term "ionic liquid" encompasses salt compounds which are liquid at less than 100° C. Usually, they are formed by an asymmetric organic cation residue, such as an [ammonium]+, [imidazolium]+ or [pyridinium]+ cation, to which an organic or inorganic anion is weakly coordinated.

The physico-chemical solvent properties of the ionic liquids differ from those of conventional organic liquids. Most of the ionic liquids have a very low vapour pressure—in practice they are non-volatile. They are not flammable and they are present in liquid phase over a broad temperature range. Further, they have an excellent ability to dissolve various organic, inorganic and polymeric compounds.

In the present context, the term "molten salt" stands for salt which is solid at standard temperature and pressure (STP) conditions, but which enters the liquid phase at elevated temperature (i.e. a temperature higher than about 25° C.). In the present context, it is preferred that the molten salts are liquid at 400° C. or less.

As discussed above, the present technology provides a method of destructing a toxic chemical, comprising the steps of mixing said one toxic chemical with a liquid phase formed by an aqueous mixture of water and an ionic liquid or molten salt which is miscible with water, said ionic liquid or molten salt comprising a tertiary amine group or quaternary ammonium group; and contacting said toxic chemical in said liquid phase with said ionic liquid or molten salt so as to decompose said toxic chemical.

In an embodiment, the aqueous composition comprises an ionic liquid or molten salt mixed with water to form a stable dispersion or solution.

The dispersion or solution may further contain at least one oxidizing agent and preferably a donor of hydrogen bonds.

In the present context, the term "stable dispersion or solution" designates a dispersion or solution from which less than 20 wt %, preferably less than 10 wt, in particular 5 wt or less, of the dispersed or dissolved phase settles out upon standing at room temperature, in particular upon standing at room temperature (15 to 25° C.) for 24 hours.

The ionic liquid or molten salt of the present technology is essentially non-toxic at the concentration at which it is present in the liquid phase. Further, typically the ionic liquid or molten salt exhibits properties of biocompatibility, biodegradability or both.

In an embodiment, the ionic liquid or molten salt comprises a compound according to formula I

I

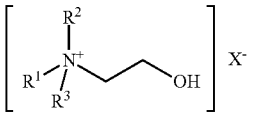

wherein each $R^1$ to $R^3$ is independently selected from the group of hydrogen and lower alkyl groups; and $X^-$ stands for an anion selected from the group of halogens, carbonates, bicarbonates, acetates, carbamates and combinations thereof.

The solvent properties of the present ionic liquid can be modified depending on the intended use by selection of suitable combinations of cations and anions. Thus, the water-solubility, melting point, viscosity and density can be changed by the selection of the anion and/or the length of the alkyl chain of the cation and by functional groups. Also the biodegradability of the ionic liquid can be influenced by the combination cation and anion.

In one embodiment, in a compound according to formula I, 2 or 3 of substituents $R^1$ to $R^3$ are hydrogen and $X^-$ stands for a halogen, bicarbonate or acetate, in particular choline chloride, carbonate, bicarbonate or acetate.

Choline cation based ionic liquids are biodegradable and essentially non-toxic. They are excellent solvents. The compounds are solvents at temperatures of about 0° C. and higher.

From ionic liquid and molten salts together with a compound donating hydrogen bonds eutectic liquids can be obtained. Thus, for example, a eutectic mixture is formed from the choline cation together with an anion, such as chloride, together with a hydrogen bond donating compound. Eutectic mixtures are liquid over a very broad temperature range. Eutectic mixtures are excellent solvents for both chemical and biological warfare agents.

In an embodiment, the ionic liquid is combined with a compound donating hydrogen bonds. Such compounds are exemplified by substances selected from the group of alcohols, polyols, such as glycol or glycerol, and carbohydrate sources, such as monomeric and polymeric saccharides, for example glucose, fructose, saccharose. Combinations of two or more of the substances listed in the foregoing can also be employed.

A particular embodiment comprises a substance selected from the group of alcohols, polyols and carbohydrates which has a melting point higher than 15° C.

In an embodiment, the concentration of the substance donating hydrogen bonds is about 1 to 50 wt %, for example about 1 to 20 wt %, of the non-aqueous part of the composition.

In an embodiment, the liquid phase contains an oxidative agent, preferably an oxidative agent selected from the group of oxone, inorganic and organic peroxides, superoxides, chlorine dioxide and ozone.

In the present context the term "oxidative species" stands for chemically reactive molecules containing oxygen. Examples of such species based on the above oxidative agents include peroxides, superoxide, hydroxyl radical, and singlet oxygen.

In a preferred embodiment, the oxidative agent has a melting point higher than 25° C.

In an embodiment, the concentration of the oxidative agent is about 0.1 to 50 wt %, for example about 0.5 to 20 wt %, of the non-aqueous part of the composition.

A combination of ionic liquids or molten salts together with oxidative agent give rise to a destructive composition which is suitable for use for example in cold climate.

Based on the above, in an embodiment, the dispersion or solution contains an ionic liquid or a molten salt or a combination thereof, in combination with an oxidizing agent and a donor of hydrogen bonds.

The dispersion or solution containing an ionic liquid or molten salt or a combination thereof together with an oxidizing agent and optionally a donor of hydrogen bonds can also contain at least one surfactant. Any surfactant suitable to reduce surface tension of water can be used; suitable surfactants are anionic, cationic or nonionic surfactants, in particular anionic surfactants such as linear alkyl benzene sulphonate, or methyl ester sulphonate.

In an embodiment, the concentration of the surfactant is about 0.1 to 30 wt %, for example about 0.5 to 15 wt %, in particular 0.8 to 10 wt-% of the non-aqueous part of the composition.

The liquid compositions of the present technology are preferably aqueous.

In an embodiment, the liquid phase contains water and ionic liquid or molten salt at a molar ratio of water to ionic liquid or molten salt at 1:100 to 100:1, preferably about 1:10 to 10:1, in particular the liquid phase contains water and ionic liquid or molten salt at a molar ratio of 8:1 to 1:1.

In an embodiment of this kind, the liquid phase, for example, contains an ionic liquid or molten salt, a polyol and water at a molar ratio of 1-20:1-20:0.5-500, in particular about 1-10:1-10:1-100, such as 1-5:1-5:1-50.

The present technology also provides a dry composition which comprises a dry blend of chemical components selected from the group of

- at least one compound according to formula I;
- a substance selected from the group of alcohols, polyols and carbohydrates which has a melting point higher than 15° C.; and
- optionally further containing an oxidative agent having a melting point higher than 25° C.

The composition is dry at least at room temperature (15 to 25° C.), and optionally in an interval of 0 to 30° C.

The term "dry" stands for "non-aqueous" and preferably "non-liquid". Typically, such a "dry" composition is a solid material.

In an embodiment, the components of the composition are exclusively non-toxic.

The dry component composition can be mixed or dissolved into water to form an aqueous suspension or an aqueous solution, respectively. In an embodiment, the concentration of the dry composition is at maximum 50% by weight of the total weight of the aqueous composition, in particular about 1 to 25% by weight.

The present technology also provides an aqueous composition comprising an ionic liquid or molten salt mixed with water to form a stable dispersion or solution, wherein said ionic liquid or molten salt comprises a tertiary amine group or quaternary ammonium group, said dispersion or solution further containing at least one oxidizing agent and optionally a donor of hydrogen bonds.

In an embodiment, in the aqueous composition the liquid phase contains water and ionic liquid or molten salt at a molar ratio of 1:100 to 100:1, preferably about 1:10 to 10:1, in particular the liquid phase contains water and ionic liquid or molten salt at a molar ratio of 8:1 to 1:1.

In an embodiment, the ionic liquid or molten salt, water and a polyol, such as glycol or glycerol, form a deep eutectic solvent.

In the present context, the term "deep eutectic solvent" stands for an ionic solvent composed of the mixture of the ionic liquid or molten salt, water and polyol and forming an eutectic which a melting point which is significantly lower than that of the individual components. Typically, the temperature difference is more than 50° C.

Generally, for the purpose of the present technology, the ionic liquid or molten salt of the dry and the aqueous compositions is selected from compounds according to formula I, which are stable as such or in the form of aqueous solutions over extended periods of time at 2 to 8° C.

In an embodiment, the ionic liquid or molten salt is selected from compounds which have a melting point in the range of 30 to 100° C.; or higher than 100° C. and up to 400° C., respectively.

In an embodiment, the aqueous mixture of water and the ionic liquid has a pH higher than 6.5, in particular higher than 7.0, preferably about 8 to 10. It has been found that destruction of many chemical agents is enhanced in the indicated pH range.

The pH of the present compositions can be influenced by the selection of the anion of the ionic liquid or molten salt. By selecting a bicarbonate or similar it is possible to buffer the pH to a range efficient for destruction of the toxic chemical. Naturally, separate buffering agents can also be incorporated into the compositions.

In an embodiment, the aqueous composition has a DIN 100 ml cup viscosity of about 15 to 30 s. Compositions have a viscosity in the indicated range are fluid enough to be spread upon surfaces using conventional equipment, even manual spraying equipment, in field conditions, while they are viscous enough to maintain on the surfaces in liquid form for a sufficient long period of time to allow for mixing with the toxic chemicals even at temperature higher than room temperature.

The compositions presented are suitable for use in methods of destructing toxic compounds or for decontaminating surfaces contaminated by toxic compounds or for combating toxic compounds in gas phase destructing of toxic chemicals, in particular chemical warfare agents.

The present compositions can be used for treating a number of toxic chemicals. Generally, the toxic chemical can be selected from the group of organic compounds, typically containing one or more heteroatoms. In case of insecticides and CWAs the toxic chemicals are in particular organophosphates, optionally containing further heteroatoms selected from nitrogen, sulphur, chlorine, fluorine and oxygen and combinations thereof.

Examples of insecticides include organophosphates, organochlorides and carbamates, in particular pyrethrins, pyrethroids, nicotine, neonicotinoids, N-methyl carbamate, ryanodine and ryanoids. Herbicides are exemplified by chlorophenoxy, pentachlorophenol and pentachlorophenol.

Chemical warfare agents are exemplified by nerve agents (tabun, sarin, soman and VX), blister agents (mustard gas, nitrogen mustard) and arsenical vesicants (lewisites), including diphenylcyanoarsine, diphenylaminechlor-arsine and diphenylchlorarsine.

By the present technology CWAs can efficiently be destructed to significantly less toxic and less harmful compounds. Thus, VX and sarin can be oxidized for example to ethylmethyl phosphonic acid (EMPA) and isopropylmethyl phosphonic acid (IMPA). Mustard gas (bis-(2-chloroethyl) sulphide, "HD") can be destructed to bis(2-chloroethyl) sulphoxide (HD-O), and 2-chloroethyl vinylsulphoxide (CEVS-O).

As a result, after decomposition of the toxic chemical by the present technology, in particular after decomposition of the toxic chemical to the extent that it is harmless, it is possible to discard the liquid phase formed when the toxic chemical has been mixed with the decomposition composition.

The present technology can be applied to decontamination of surfaces contaminated with the toxic chemicals. The present technology can also be used for destructuring of stockpiled or otherwise stored toxic chemicals as well as for combating toxic chemicals in gas phase.

In an embodiment, the surface to be treated typically is contaminated by the toxic chemical present on the surface in the form of a liquid or as a solid substance, such as a powder. The step of mixing the toxic chemical with the liquid phase is then carried out by applying the liquid phase onto the surface contaminated by the toxic chemical.

During the mixing, the toxic chemicals are dissolved in the liquid phase containing the ionic liquid or molten salt(s) or they are mixed with the liquid phase to form a heterophasic mixture. In both cases, the toxic chemicals are decomposed by the action of the liquid phase enhanced by oxidation and optionally by hydrolysis.

In one particular embodiment of the surface treatment, the liquid phase is applied by spraying, atomizing or pouring of the liquid phase onto the surface contaminated by the toxic chemical. In another embodiment, the liquid phase is applied by immersing the surface contaminated by the toxic chemical into a bath formed by the liquid phase.

The step of surface treatment with the present compositions can be carried out as one or several steps of a multi-step process for generally rinsing and decontaminating a contaminated surface. Typically, the rinsing and decontaminating process comprises also at least one step of rinsing using a surface active compound and optionally of washing with abundant amounts of water.

Toxic chemicals are typically stockpiled and otherwise stored in vessels or containers, occasionally even in ammunition cartridges or as warheads.

To destruct the toxic chemicals, the present compositions are preferably fed directly into the container containing that toxic chemical. It is naturally also possible to feed the toxic chemical into a vessel filled with the present compositions and to mix it with the active components of the compositions.

One embodiment comprises spraying or atomizing the liquid phase into a gas phase containing the toxic chemical, for example as a gas or as an aerosol. The liquid composition can be atomized through an atomizing nozzle, thus forming for example a fog or mist of the liquid composition.

In one embodiment, the liquid composition is stored in a container combined with a conventional sprinkler system, either for outdoor or indoor use. Thus, in one embodiment, a container with the present composition is coupled with the feed piping of a fire sprinkler system to allow for atomizing the composition into gas phase to combat any inadvertent or deliberate release of toxic chemicals into spaces accessed by humans or animals. The present composition can be atomized together with water conventionally released through the atomizing nozzle or separately.

In all of the above embodiments, the contacting of the toxic chemical with the present compositions is continued until the toxic chemical is rendered harmless. Depending on the concentration of the toxic chemical, whether in gas phase or in liquid or solid forms, the contacting time may vary within the range of 1 s to 600 min. Typically, a contacting time of 1 to 240 min is sufficient for destructing.

In embodiments where there is an oxidative agent incorporated into the present compositions, the toxic chemical should preferably be contacted with a stoichiometric excess of the oxidative agent or of the reactive oxidative species of the oxidative agent. In particular there should be used a molar amount of the oxidative agent, or of the reactive oxidative specie of the oxidative agent, which is 1.5 to 1000 times, for example 2 to 500 times or 3 to 100 times, in particular 7 to 50 times, for example 10 to 20 times the molar amount of the toxic chemical.

As discussed above, by incorporating buffering components, such as bicarbonates, into the present compositions, the pH can be kept in an efficient range, typically an alkaline range, throughout the reaction time needed for destruction of the toxic compounds.

The following non-limiting examples illustrate the present technology.

Example 1

Choline bicarbonate (ChBc) was mixed at room temperature (+23° C.) with water and glucose at a molar ratio (ChBc/Glu/Water) of 1:1:10. An aqueous solution of hydrogen peroxide was added to give a concentration of $H_2O_2$ of 1.5 wt %. The solution thus obtained was liquid at both room temperature and at −20° C. The pH of the solution was 8.7 and the DIN 100 ml cup viscosity was 15 s.

Thermal analysis (DSC) indicated that no glass transition points or melting points were present in the temperature interval from −60° C. to +60° C.

The solution was tested for decomposition of three CWAs, viz. sarin, VX and mustard gas. The solution was employed at three molar percentages of $H_2O_2$. The results are shown in FIGS. 1 to 3.

As will appear from FIG. 1, sarin was completely decomposed within an hour even with the use of very small concentrations of hydrogen peroxide and the decomposition products were mainly formed by the substantially non-toxic isopropyl methylphosphonic acid (IMPA).

Figure 2:
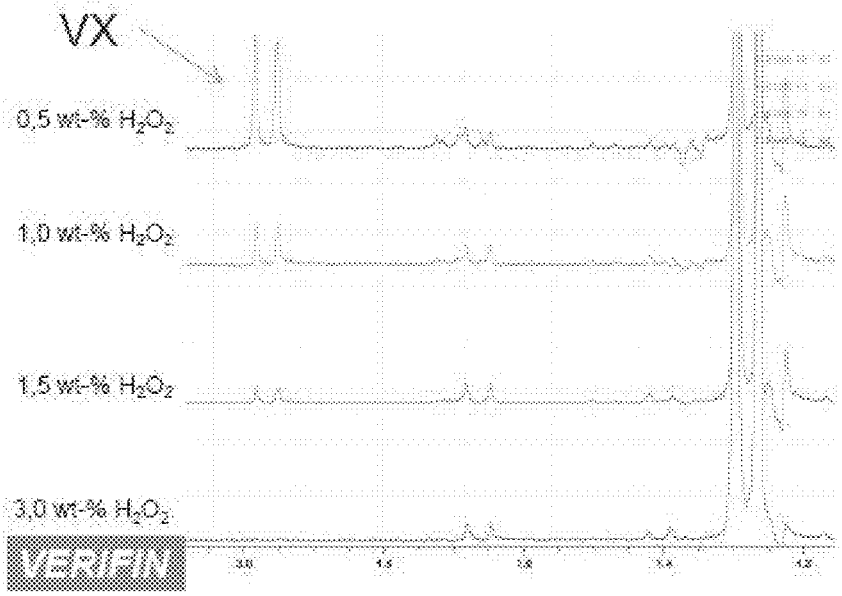
FIG. 2 shows a 1D $^{1}H$-$^{31}P$ HSQC spectrum after 1 hour decontamination of VX using the present compositions at three different concentrations of hydrogen peroxide and BD60 (choline bicarbonate-glucose-$H_2O$ 1:1:10)

FIG. 2 shows that at a concentration of 1.5 wt % hydrogen peroxide the content of VX was reduced to 1% already after 1 hour.

Figure 3:
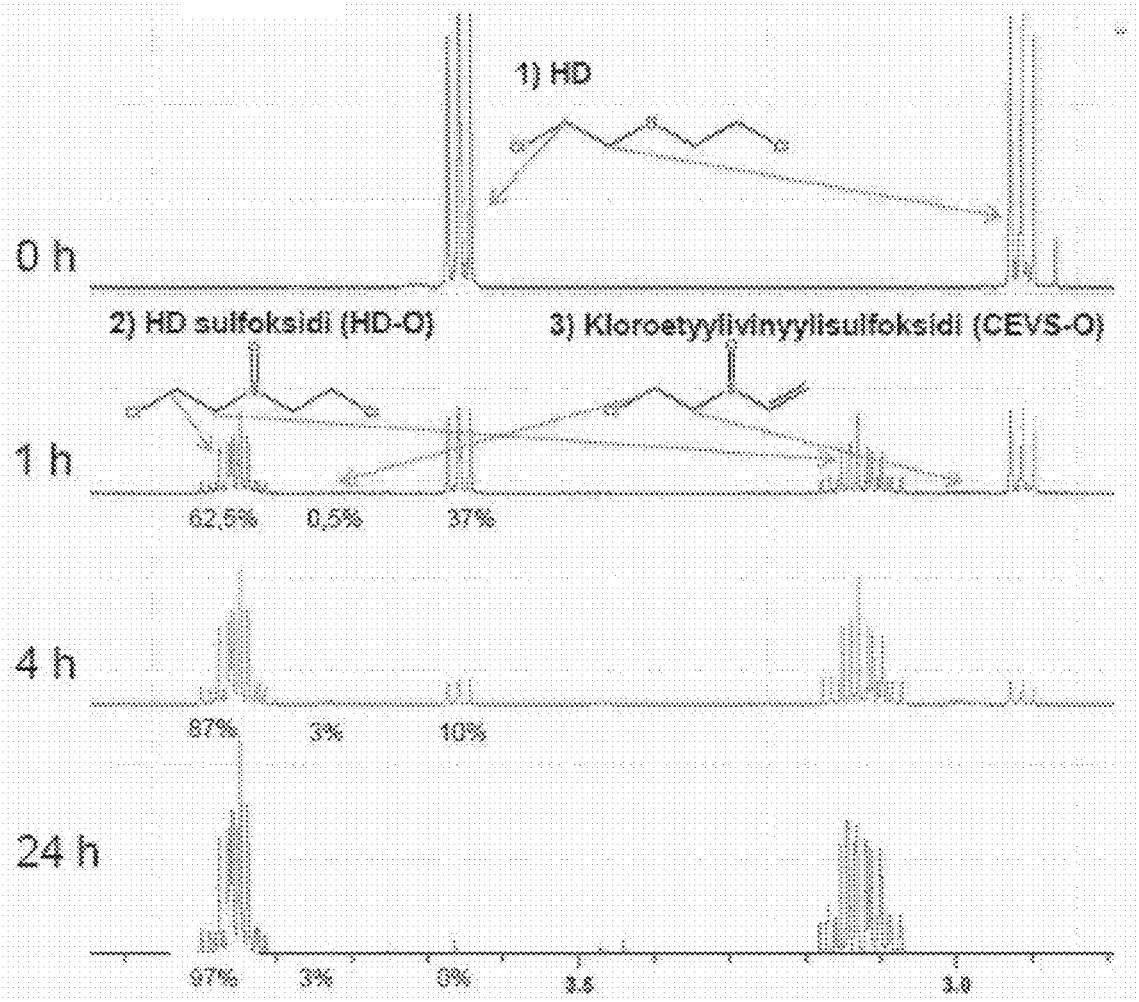
FIG. 3 shows an $^{1}H$-NMR spectrum after 0 h to 24 h of decontamination of mustard gas using the present compositions with hydrogen peroxide and BD60 (choline bicarbonate-glucose-$H_2O$ 1:1:10)

FIG. 3 shows that the concentration of mustard gas was strongly reduced within 24 hours.

By adding surfactant, such as methyl ester sulphonate, into the composition, the decomposition of mustard gas could be enhanced.

Example 2

A series of five other tests were carried out using a solution of choline bicarbonate-glucose-$H_2O$ at weight ratios of 1:1:10, with various oxidants.

Figure 4:
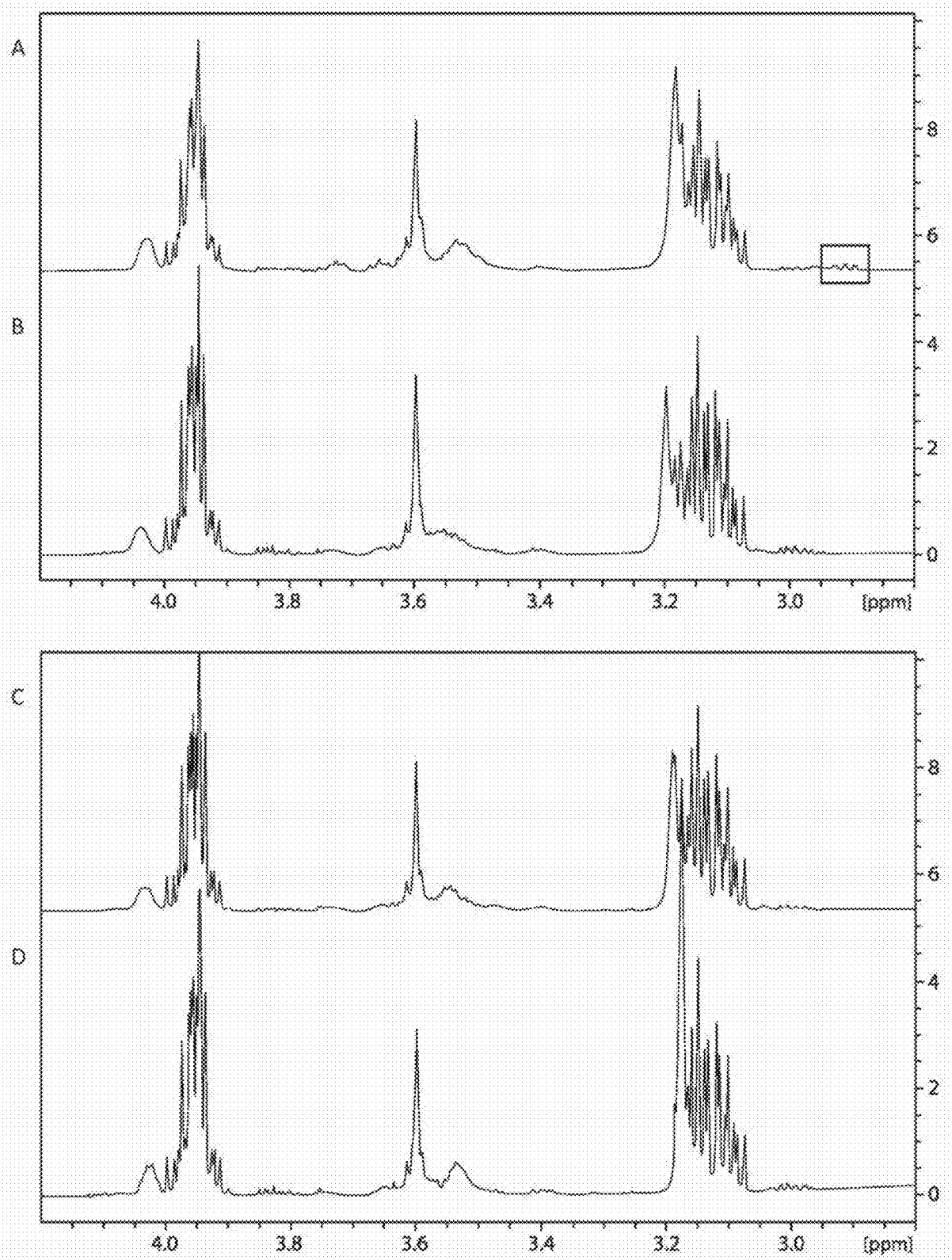
FIG. 4 shows an $^{1}H$-NMR spectrum for sulfur mustard degradation reactions with BD80 (choline bicarbonate-glycerol-$H_2O$ 1:1:10+4 w/w % surfactant) using liquid $H_2O_2$ as the oxidation reagent.

FIG. 4 shows the $^1H$ NMR spectrum for the use of choline bicarbonate-glucose-$H_2O$ at weight ratios of 1:1:10, for degrading mustard gas:

At point

A: After 30 min reaction time using 3 wt % of liquid $H_2O_2$. Approx. 1% of HD remaining, $H_a$(HD) shown in the blue box.

B: After 60 min reaction time using 3 wt % of liquid $H_2O_2$. HD has completely degraded.

C: After 30 min reaction time using 8 wt % of liquid $H_2O_2$. HD has completely degraded D: After 30 min reaction time using 8 wt % of liquid $H_2O_2$. HD has completely degraded.

Figure 5:
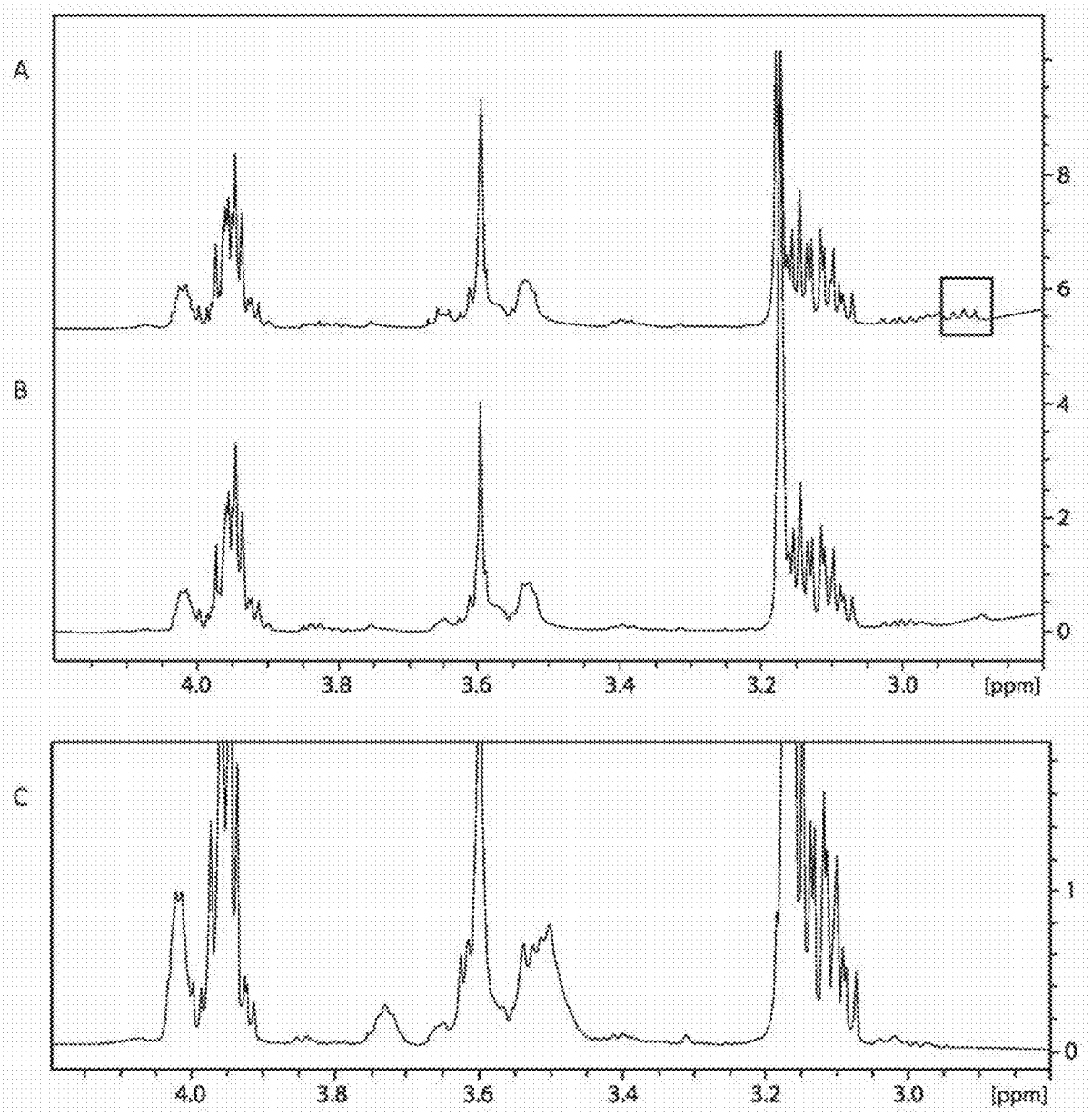
FIG. 5 shows an $^{1}H$-NMR spectrum for sulfur mustard degradation reaction with BD80 (choline bicarbonate-glycerol-$H_2O$ 1:1:10+4 w/w % surfactant) using urea-$H_2O_2$ as the oxidation reagent.

FIG. 5 shows the degradation reaction of mustard gas with BD80 (choline bicarbonate-glycerol-$H_2O$ 1:1:10+4 wt % surfactant) using urea-$H_2O_2$ as the oxidation reagent.

$^1H$ NMR spectrum at point

A: After 30 min reaction time using 10 eq of urea-$H_2O_2$. Approx. 3% of HD remaining, $H_a$(HD) shown in the blue box.

B: After 60 min reaction time using 10 eq of urea-$H_2O_2$. HD has completely degraded.

C: After 30 min reaction time using 20 eq of urea-$H_2O_2$. HD has completely degraded.

Figure 6:
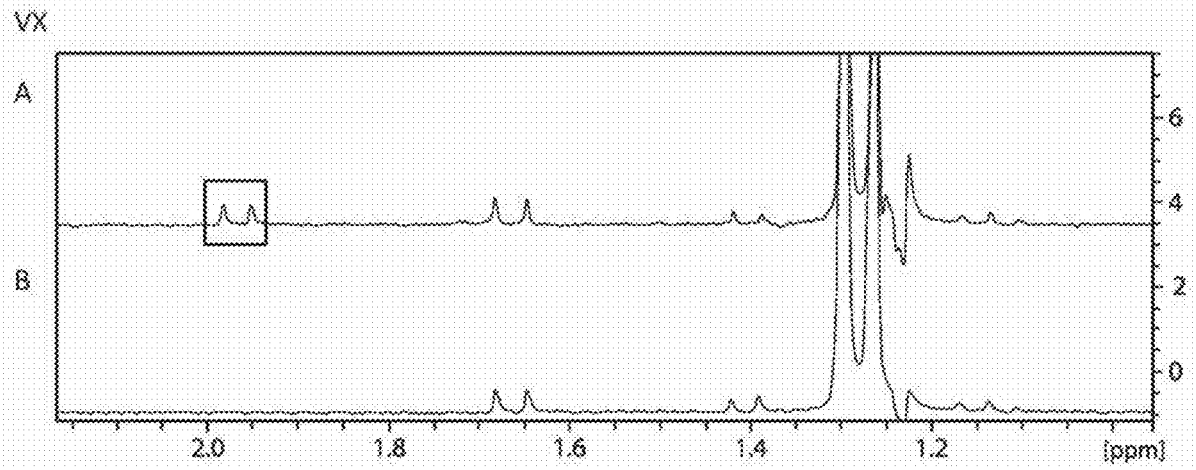
FIG. 6 shows a 1D $^{1}H$-$^{31}P$ HSQC spectrum for a VX degradation reaction with BD60 (choline bicarbonate-glucose-$H_2O$ 1:1:10) using liquid $H_2O_2$ as the oxidation reagent (reaction time 30 min)

FIG. 6 shows the degradation reaction of VX with BD60 (choline bicarbonate-glucose-$H_2O$ 1:1:10) using liquid $H_2O_2$ as the oxidation reagent (reaction time 30 min).

1D $^1H$-$^{31}P$ HSQC spectrum of

A: using 1.5 wt % of liquid $H_2O_2$. Approx. 1% of VX remaining, $H_a$(VX) shown in the blue box.

B: using 3 wt % of liquid $H_2O_2$. VX has completely degraded.

Figure 7:
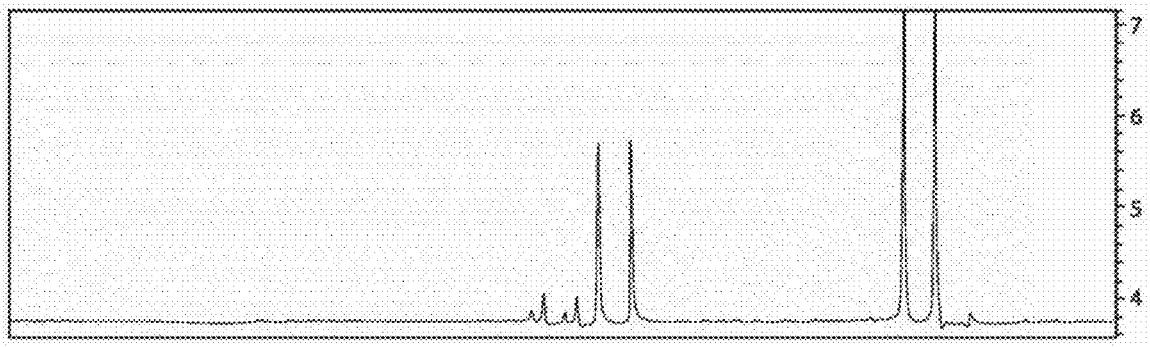
FIG. 7 shows a 1D $^{1}H$-$^{31}P$ HSQC spectrum for. VX degradation reaction with BD80 (choline bicarbonate-glycerol-$H_2O$ 1:1:10+4 w/w % of surfactant) using liquid $H_2O_2$ as the oxidation reagent.

FIG. 7 shows the degradation reaction of VX with BD80 (choline bicarbonate-glycerol-$H_2O$ 1:1:10+4 wt % of surfactant) using liquid $H_2O_2$ as the oxidation reagent.

A 1D $^1H$-$^{31}P$ HSQC spectrum of after 30 min reaction time using 8 wt % of liquid $H_2O_2$. VX has completely degraded.

Figure 8:
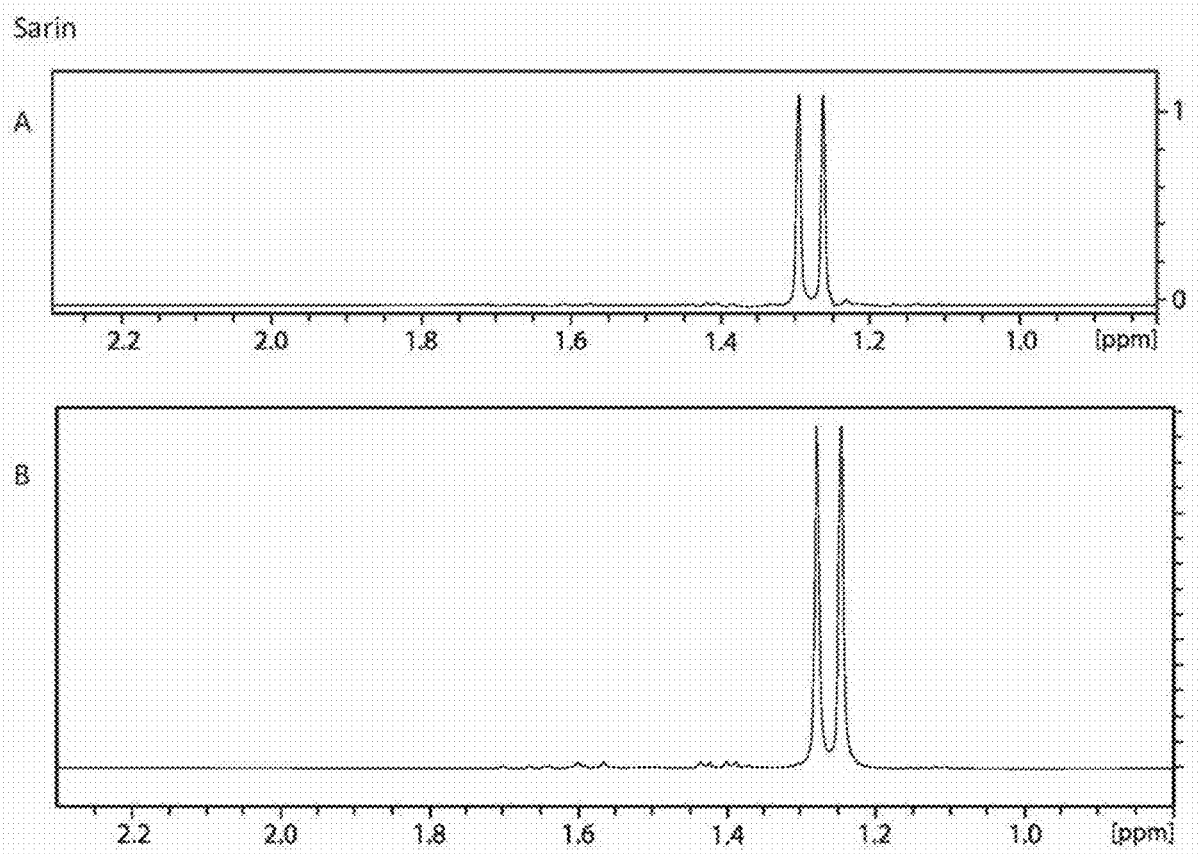
FIG. 8 shows a 1D $^{1}H$-$^{31}P$ HSQC spectrum after 30 min reaction time.

FIG. 8 shows the degradation reaction of sarin by means of a 1D $^1H$-$^{31}P$ HSQC spectrum.

After 30 min reaction time.

A: Sarin degradation reaction with BD60 (choline bicarbonate-glucose-$H_2O$ 1:1:10) using 3 wt % of liquid $H_2O_2$. Sarin has completely degraded. B: Sarin degradation reaction with BD80 (choline bicarbonate-glycerol-$H_2O$ 1:1:10+4 wt % of surfactant) using 3 wt % liquid $H_2O_2$. Sarin has completely degraded.

INDUSTRIAL APPLICABILITY

The present method and compositions can be used in environmental friendly decontamination of chemical warfare agents (CWA) as well as other toxic compounds, such as insecticides and herbicides. The method can be used at the sub-zero conditions in polar regions and in the hot conditions in deserts, semideserts and tropical regions. The present invention can be used for decontaminating equipment and personnel subjected to such toxic compounds, and for destructing stockpiled chemical agents. It can also be used by atomizing the liquid to form an active fog or mist for combating attacks with toxic chemicals directed against civilians and military staff.

CITATION LIST

Patent Literature

U.S. Pat. No. 5,100,477
US 20100119412

The invention claimed is:

1. A method of destructing a toxic chemical comprising the steps of:

mixing said toxic chemical with a liquid phase formed by an aqueous mixture of water and an ionic liquid or molten salt which is miscible with water, said ionic liquid or molten salt comprising a compound according to formula I:

I

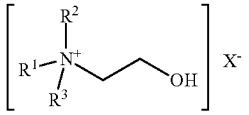

wherein each of $R^1$ to $R^3$ is independently selected from the group of hydrogen and lower alkyl groups; and $X^-$ stands for an anion selected from the group of halogens, carbonates, bicarbonates, acetates, carbamates and combinations thereof; and contacting said toxic chemical in said liquid phase with said ionic liquid or molten salt so as to decompose said toxic chemical, and wherein the aqueous composition comprising water and the ionic liquid or molten salt has a pH of 6.5 or higher.

2. The method according to claim 1, wherein the liquid phase further comprises an oxidative agent selected from the group consisting of oxone, inorganic and organic peroxides, superoxides, chlorine dioxide, and ozone.

3. The method according to claim 1, wherein the liquid phase contains a donor of hydrogen bonds.

4. The method according to claim 1, wherein the liquid phase further comprises an alcohol, a polyol, a carbohydrate source, or a combination thereof.

5. The method according to claim 1, wherein the liquid phase contains water and ionic liquid or molten salt at a molar ratio of water to ionic liquid or molten salt at 1:10 to 10:1.

6. The method according to claim 1, wherein the liquid phase contains a deep eutectic solvent formed by an ionic liquid or molten salt, water and a polyol.

7. The method according to claim 1, wherein the liquid phase contains an ionic liquid or molten salt, a polyol and water at a molar ratio of 1-20:1-20:0.5-500.8.

8. The method according to claim 2, further comprising contacting the toxic chemical with a stoichiometric excess of the oxidative agent, which is 1.5 to 1000 times the molar amount of the toxic chemical.

9. The method according to claim 1, comprising dissolving the toxic chemical in the liquid phase, and decomposing the toxic chemical in said liquid phase by at least one of: hydrolysis and a combination of hydrolysis and oxidization.

10. The method according to claim 1, comprising mixing a hydrophobic phase formed by the toxic compound with the liquid phase formed by the aqueous mixture to form a heterophasic mixture and decomposing the toxic chemical in said heterophasic mixture by oxidization and optionally by hydrolysis.

11. The method according to claim 1, wherein the ionic liquid or molten salt is essentially non-toxic at the concentration at which it is present in the liquid phase, and the ionic liquid or molten salt exhibits properties of biocompatibility, biodegradability or both.

12. The method according to claim 1, wherein the aqueous mixture of water and the ionic liquid has a pH greater than 6.5.

13. The method according to claim 1, wherein the composition further contains a surfactant.

14. The method according to claim 1, wherein the toxic chemical is selected from the group of organophosphates, optionally containing further heteroatoms selected from nitrogen, sulfur, chlorine, fluorine, oxygen and combinations thereof and chemical warfare agents.

15. The method according to claim 1, wherein 2 or 3 of substituents $R^1$ to $R^3$ are hydrogen or methyl and $X^-$ stands for a halogen, carbonate, bicarbonate or acetate.

16. The method according to claim 1, wherein the step of mixing the toxic chemical with the liquid phase comprises applying the liquid phase onto a surface contaminated by the toxic chemical or by immersing the surface contaminated by the toxic chemical into a bath formed by the liquid phase.

17. The method according to claim 1, wherein the step of mixing the toxic chemical with the liquid phase comprises mixing the liquid phase with the toxic chemical in a container containing the toxic chemical; or spraying or atomizing the liquid phase into a gas phase containing the toxic chemical, wherein the gas phase contains the toxic chemical as a gas or as an aerosol.

18. A composition suitable for use in a method of destructing a toxic chemical, the composition comprising a dry blend of chemical components, the dry blend of chemical components comprising:

at least one compound according to formula I, wherein 2 or 3 of substituents $R^1$ to $R^3$ are hydrogen or methyl and $X^-$ stands for a halogen, carbonate, bicarbonate or acetate

I

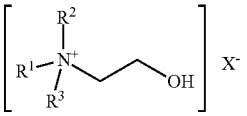

a substance selected from the group consisting of alcohols, polyols, and carbohydrates, the substance having a melting point higher than 15° C.; and optionally an oxidative agent having a melting point higher than 25° C.

19. An aqueous composition comprising an ionic liquid or molten salt selected from a compound according to formula I:

I

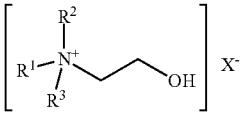

wherein each $R^1$ to $R^3$ is independently selected from the group consisting of hydrogen and lower alkyl groups; and wherein $X^-$ stands for an anion selected from the group consisting of halogens, carbonates, bicarbonates, acetates, carbamates and combinations thereof, mixed with water to form a stable dispersion or solution, said dispersion or solution further comprising at least one oxidizing agent and optionally a donor of hydrogen bonds, wherein the aqueous composition comprising the ionic liquid or molten salt has a pH of 6.5 or higher.

20. The aqueous composition according to claim 19, wherein the liquid phase contains water and the ionic liquid or molten salt at a molar ratio of 1:10 to 10:1.

21. The aqueous composition according to claim 19, further comprising a polyol, and wherein the ionic liquid or molten salt, water, and the polyol form a deep eutectic solvent.

22. The aqueous composition according to claim 19, comprising the compound according to formula I,

I

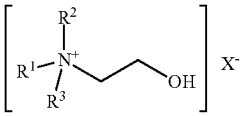

wherein each $R^1$ to $R^3$ are methyl and X—=halogen.

23. The aqueous composition according to claim 19, further comprising a surfactant at a concentration of about 0.1 to 30 wt % of a non-aqueous part of the composition.

24. The aqueous composition according to claim 19, wherein the composition comprises a dry blend of:

the at least one compound according to formula I;

a substance selected from the group consisting of alcohols, polyols and carbohydrates which has a melting point higher than 15° C.; and the oxidative agent having a melting point higher than 25° C.

25. The aqueous composition according to claim 24, wherein the concentration of the dry blend is about 1 to 25% by weight of the total weight of the aqueous composition.

26. The aqueous composition according to claim 19, wherein the oxidative agent is selected from the group consisting of oxone, inorganic and organic peroxides, superoxides, chlorine dioxide, and ozone.

27. The aqueous composition according to claim 19, wherein the liquid phase contains water and the ionic liquid or molten salt at a molar ratio of 8:1 to 1:1.

28. The aqueous composition according to claim 19, said oxidative agent is present at a concentration of about 0.5 to 20 wt % of a non-aqueous part of the composition.

29. The method according to claim 1, wherein the aqueous composition has a pH greater than 7.

* * * * *